US010772794B2

(12) United States Patent
Swegle et al.

(10) Patent No.: US 10,772,794 B2
(45) Date of Patent: Sep. 15, 2020

(54) PHARMACEUTICAL PACKAGING DEVICE

(71) Applicant: MEDPHARM HOLDINGS, LLC, Denver, CO (US)

(72) Inventors: Thomas Swegle, Des Moines, IA (US); Bounnak M. Thammavong, Iowa City, IA (US)

(73) Assignee: MEDPHARM HOLDINGS, LLC, Denver, CO (US)

( * ) Notice: Subject to any disclaimer, the term of this patent is extended or adjusted under 35 U.S.C. 154(b) by 120 days.

(21) Appl. No.: 15/721,065

(22) Filed: Sep. 29, 2017

(65) Prior Publication Data

US 2018/0125751 A1 May 10, 2018

Related U.S. Application Data

(60) Provisional application No. 62/419,727, filed on Nov. 9, 2016.

(51) Int. Cl.

| | |
|---|---|
| ***A61J 1/03*** | (2006.01) |
| ***A61J 7/00*** | (2006.01) |
| ***B65D 81/38*** | (2006.01) |
| ***B65D 50/04*** | (2006.01) |
| ***B65D 21/02*** | (2006.01) |
| ***A61J 1/14*** | (2006.01) |

(52) U.S. Cl.

CPC ..... *A61J 1/03* (2013.01); *A61J 1/1425* (2015.05); *A61J 7/0076* (2013.01); *B65D 21/022* (2013.01); *B65D 21/0213* (2013.01); *B65D 50/046* (2013.01); *B65D 81/3813* (2013.01)

(58) Field of Classification Search

CPC ..... A61J 1/03; A61J 1/1425; A61J 7/0076; B65D 81/3813; B65D 50/046; B65D 21/0213; B65D 21/022

USPC ..... 206/538, 528, 539, 509

See application file for complete search history.

(56) References Cited

U.S. PATENT DOCUMENTS

| | | | | | |
|---|---|---|---|---|---|
| 3,227,127 | A * | 1/1966 | Gayle | A61J 7/04 | 116/308 |
| 4,235,338 | A * | 11/1980 | Dugan | B65D 1/22 | 206/443 |
| 4,693,371 | A * | 9/1987 | Malpass | B65D 1/36 | 206/534 |
| 5,154,296 | A * | 10/1992 | Cutler | B65D 83/0454 | 206/533 |
| 6,758,338 | B2 * | 7/2004 | Lien | B65D 25/10 | 206/534 |
| 7,828,149 | B2 * | 11/2010 | Kalvelage | B65D 75/367 | 206/532 |

* cited by examiner

*Primary Examiner* — Steven A. Reynolds
(74) *Attorney, Agent, or Firm* — Nyemaster Goode P.C.

(57) ABSTRACT

A device for storing pharmaceuticals that includes a bottom portion having wells and a lid having correlating well covers. The wells and cover are manufactured from an insulating material which protects the medication from heat and moisture. The bottom portion and lid preferably includes matching tabs to assist the user in lining up the lid with the bottom. The device may include a child resistant rim on the bottom portion that "locks" the lid onto the device when it is closed. The lid of the device may include a protrusion which interlocks with a complimentary indentation in the bottom of an additional device to allow for easy transport of additional pharmaceuticals. The device may further include a hanger hole for easy transport of the device.

9 Claims, 5 Drawing Sheets

PHARMACEUTICAL PACKAGING DEVICE

CROSS-REFERENCE TO RELATED APPLICATION

This application claims priority to U.S. Provisional Application Ser. No. 62/419,727 filed Nov. 9, 2016, the disclosure of which is hereby incorporated herein by reference in its entirety.

BACKGROUND OF THE INVENTION

People often need a portable means of carrying their medications. There are a variety of medication carriers available in the marketplace. While conventional carriers are typically fine for use with most types of medication, such carriers are typically not suitable for use with medications that are sensitive to heat or moisture. Conventional carriers are also usually bulky and inconvenient to carry.

Therefore, the proceeding disclosure provides improvements over existing designs.

SUMMARY OF THE INVENTION

According to one aspect, a pharmaceutical packaging device that can hold a numerous doses of heat and/or moisture-sensitive medications. The device includes at least one well for housing an individual dose of medication, each well having a cover. The wells and cover are manufactured from an insulating material which protects the medication from heat and moisture. In a preferred embodiment, the bottom and top of the device have matching tabs so the user can easily align the top and bottom portions of the devices and likewise the wells to their coordinating well covers.

The packaging device includes a number of optional features. One such feature is a child resistant mechanism which includes a flexible ring or rim on the bottom of the device which clamps to the lid to prevent opening of the lid until and unless the user bends back or inverts the rim to unlock the lid.

The lid of the device is optionally manufactured with a raised portion or protrusion which matches or "nests" within a complimentary indentation in the bottom of a second device, allowing the devices to interlock to allow the user to easily transport additional doses of medication. The device may additionally include a hanger hole so the device may be easily inserted onto the user's key ring or other implement to carry or hang the device.

BRIEF DESCRIPTION OF THE DRAWINGS

While the specification concludes with claims particularly pointing out and distinctly claiming the invention, it is believed that the various exemplary aspects of the invention will be better understood from the following description taken in conjunction with the accompanying drawings, in which:

DETAILED DESCRIPTION OF THE PREFERRED EMBODIMENT

Referring to the figures, there is generally disclosed in FIGS. 1-9 a pharmaceutical device 10 configured to hold various types of pharmaceuticals, including tablets, capsules, suppositories, troches, lozenges, pastilles, pills, granules, etc. The device 10 is especially suited for pharmaceuticals that are susceptible or degrade due to heat and/or moisture. In one embodiment, the device is used to house or carry cannabis extracts such as concentrates known as "shatter", "crumble', wax, or honeycomb. Shatter, for example, has a sticky constituency at room temperature. In a conventional pharmaceutical storage system, the shatter can melt when exposed to increased temperatures, thus ruining the shape of the pharmaceutical, making a mess inside the storage device, and/or oozing into other pharmaceuticals stored within the same device.

In a preferred embodiment of the invention, the device 10 is manufactured from one or more insulating materials including, but not limited to, heat-resistant plastic, polystyrene, fiberglass, rubber, cork, wood, etc. The materials used are preferably flexible. The insulating properties of the materials help protect the pharmaceutical from heat and moisture.

The device 10 includes a top portion or lid 20 that covers and protects the pharmaceutical (not shown) housed in the bottom portion 30. When placed upon the bottom portion 30, the lid 20 preferably fits flush with the bottom 30 to help prevent air or moisture from reaching the pharmaceutical contained therein.

Figure 1:
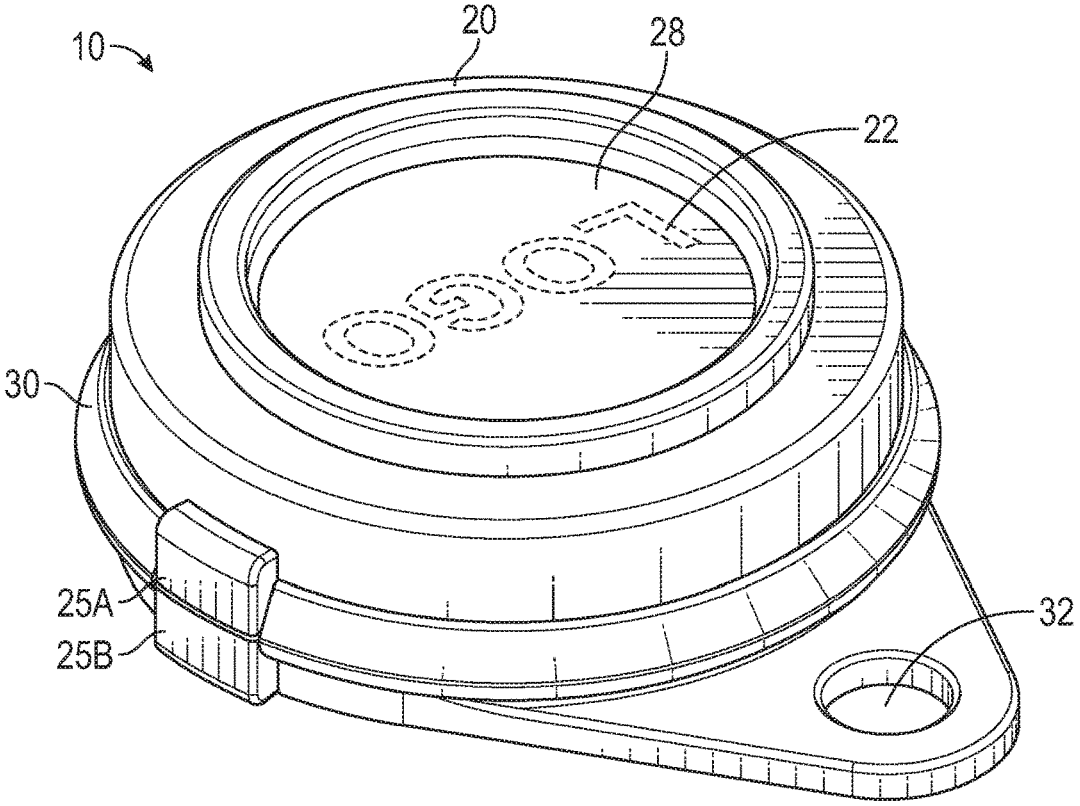
FIG. 1 is a perspective view illustrating exemplary aspects of the device.
Figure 2:
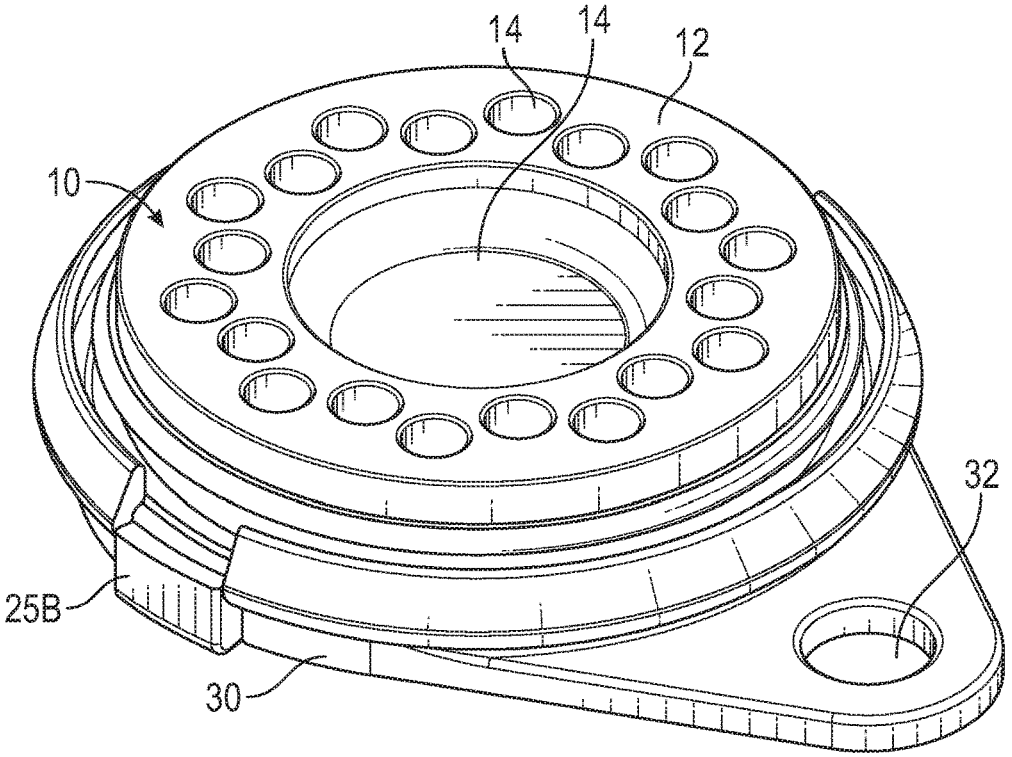
FIG. 2 is a perspective view of the bottom portion showing an exemplary embodiment of the device.
Figure 3:
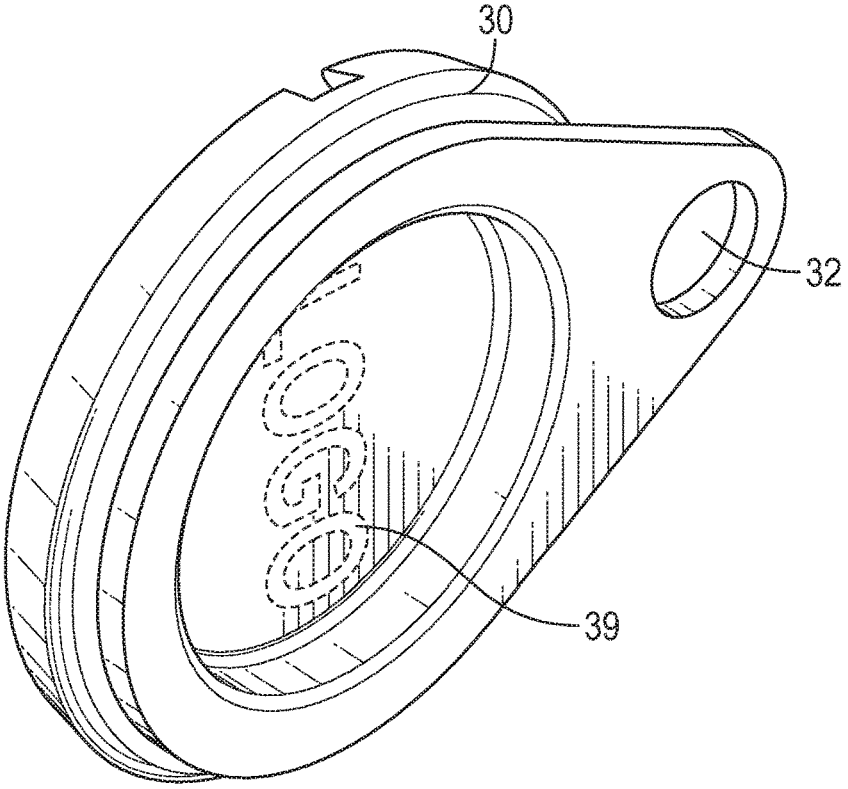
FIG. 3 is a perspective view underneath the bottom portion showing an exemplary embodiment of the device.

Referring to FIG. 2, the bottom 30 of the device 10 houses the pharmaceutical in a tray 12 containing at least one well 14. The wells 14 can be of any size depending upon the size of the pharmaceutical to be contained therein. There can also be any number of wells, again depending upon the size of the pharmaceuticals and the size of the device 10 itself. FIG. 2 shows one embodiment of the device 10 having a large well 14 in the center of the tray 12 intended for placement of larger-sized pharmaceuticals. Surrounding the large well 14 are numerous smaller-sized wells 14. The device 10 can include wells 14 all of the same size and shape or of different sizes and shapes. The wells 14 can be placed in any configuration or pattern in the tray 12. For example, the wells 14 can be placed in 7 rows coordinating with the days of the week so the user can keep a week's worth of meds in the device 10. Alternatively, the wells can be placed to form an aesthetically pleasing design, logo, etc. At least some of the wells are preferably placed along the outer portions of the device 10 to allow easy access to the pharmaceuticals by the user.

Figure 4:
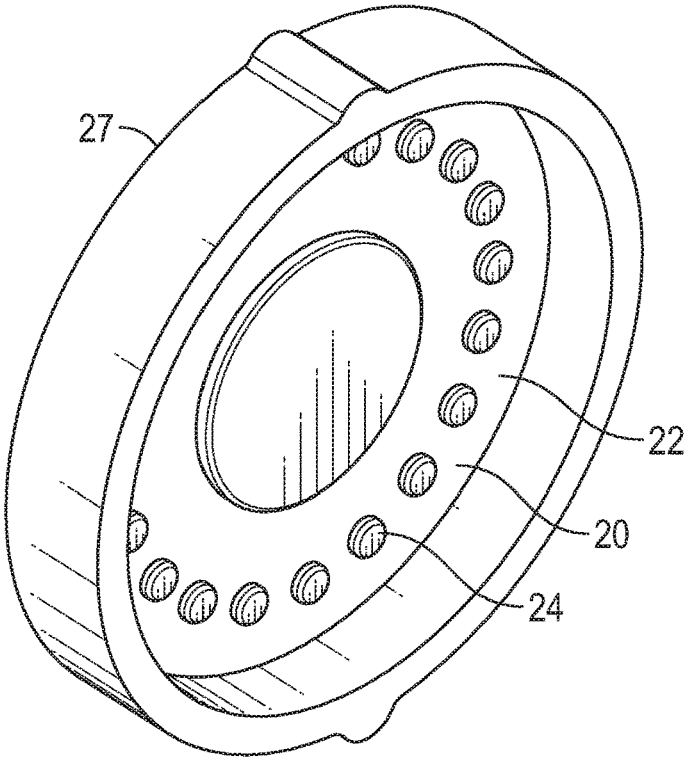
FIG. 4 is a perspective view of the inside portion of the lid showing an exemplary embodiment of the device.
Figure 8:
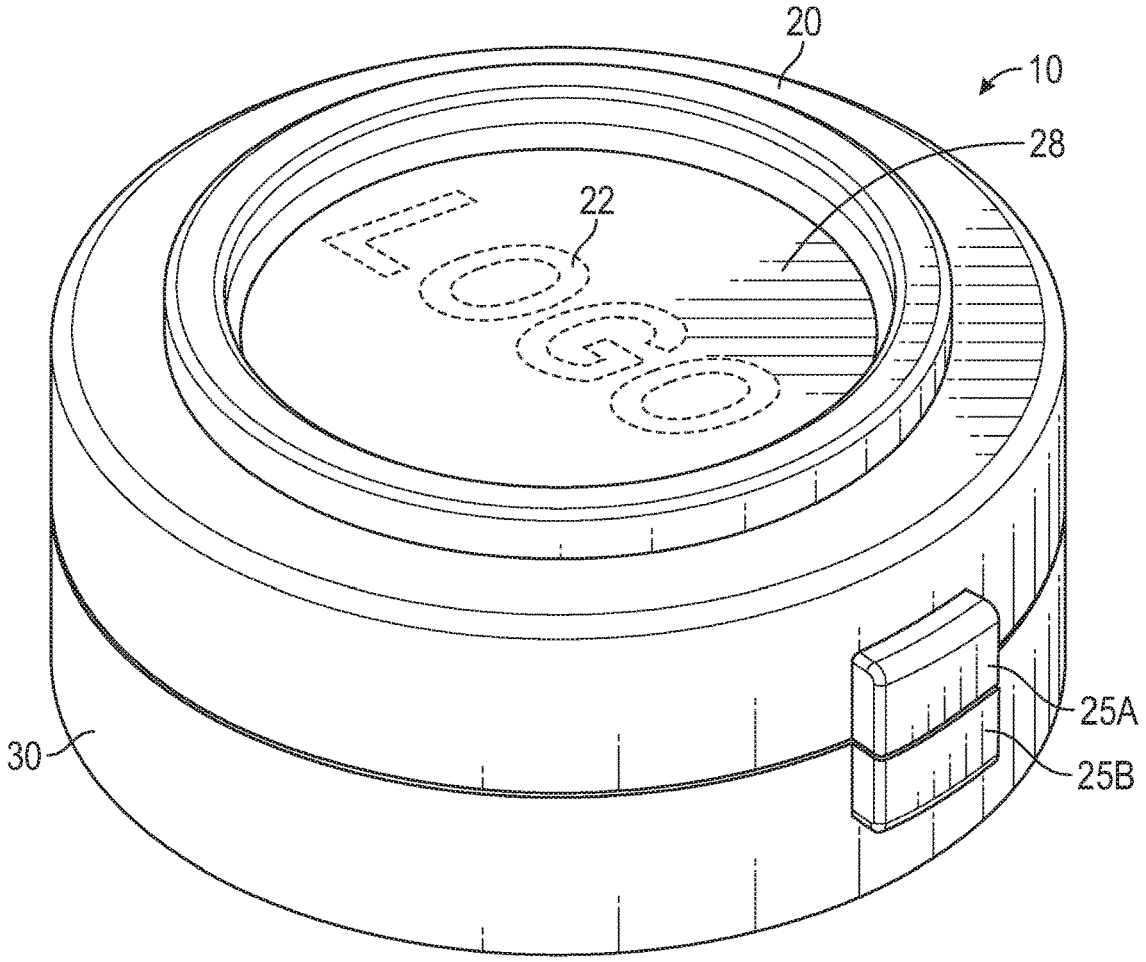
FIG. 8 is a perspective view of the closed device.

Referring to FIG. 4, the inner portion 22 of the lid 20 includes well covers 24 which correlate to and cover the wells 14 of the bottom 30. The well covers 24 are at least slightly raised projections or disks arranged on the inner portion 22 of the lid 20 which provide a sealing effect to the pharmaceuticals inside the wells 14. When the device 10 is closed as shown in FIG. 8, the well covers 24 seal and fill the space inside the wells 14 to the extent sufficient to provide protection for the pharmaceutical contained therein without encroaching on the space sufficient for the pharmaceutical inside the well 14.

While the device 10 offers some protection to the pharmaceuticals contained therein, even if the device 10 is subjected to a level of heat that causes the pharmaceuticals to melt, the pharmaceuticals remain contained in the individual wells 14 and are thereby prevented from merging and/or bleeding into surrounding pharmaceuticals. The wells 14 further serve the purpose of retaining the shape of pharmaceuticals which have melted in the wells 14 such that the pharmaceuticals retain the shape of the wells 14 once resolidified.

Figure 6:
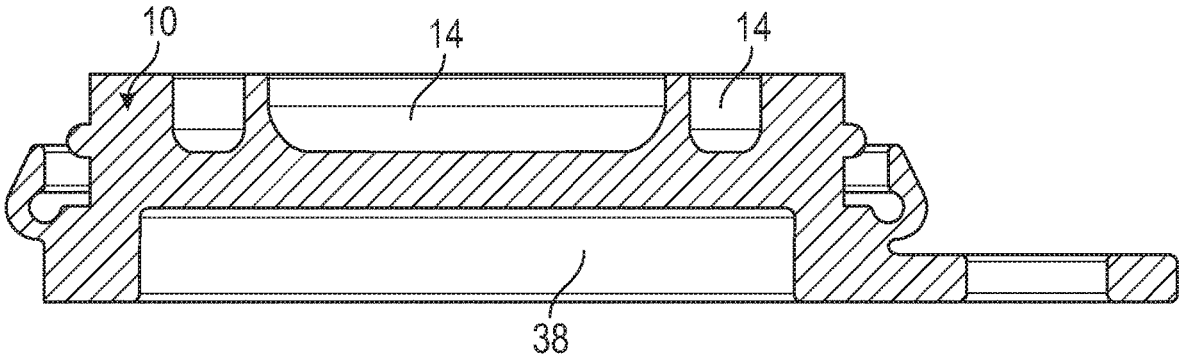
FIG. 6 is a side view of the bottom of the device.
Figure 7:
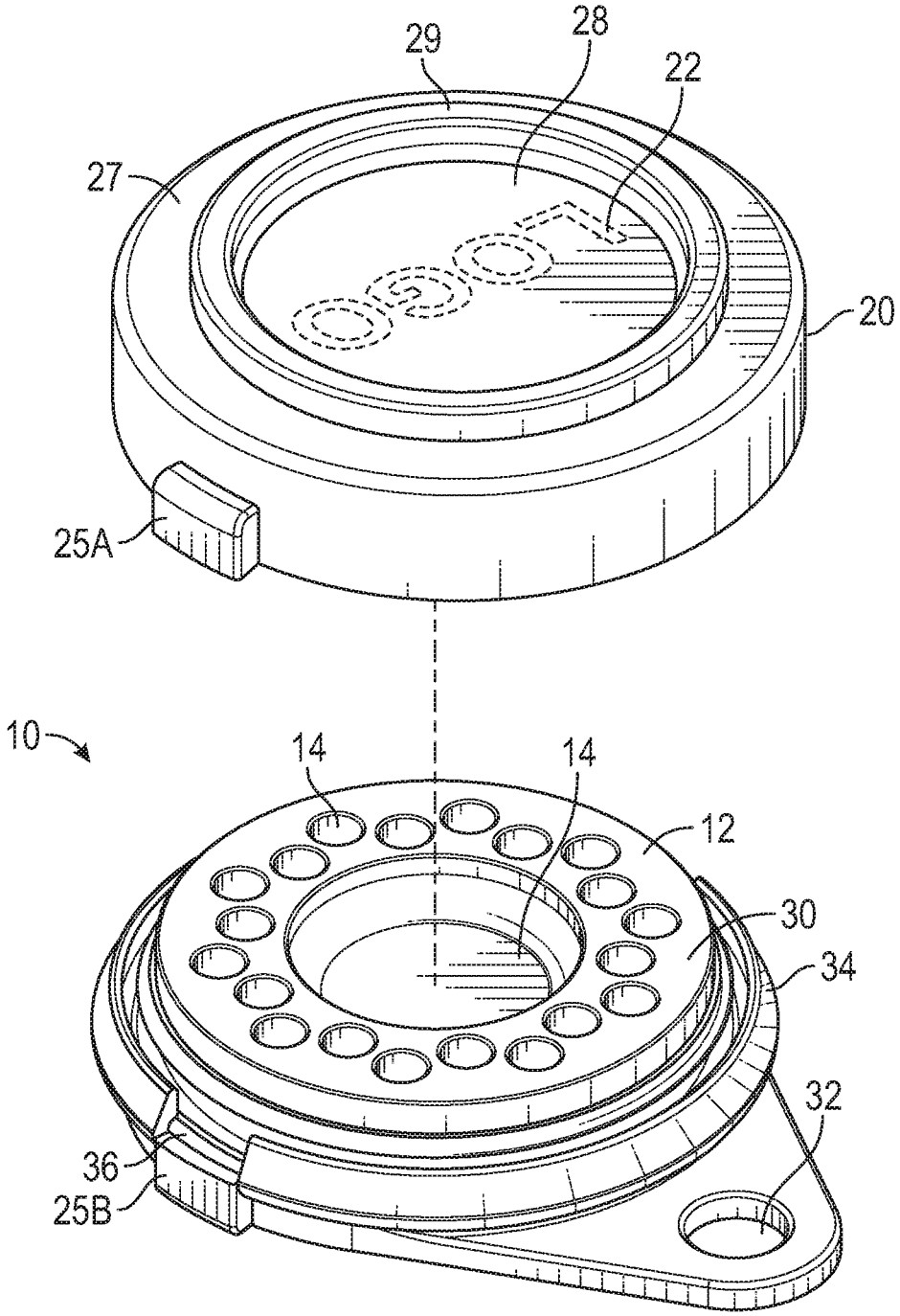
FIG. 7 is an exploded view showing an exemplary embodiment of the device.

Referring to FIG. 7, in one embodiment, the lid 20 and bottom 30 each include at least one guide 25A and 25B, respectively, which the user can use to line up the lid 20 with the bottom 30 and close the device 10 so that the wells 14 align with corresponding well covers 24 to provide the desired sealing effect. In a preferred embodiment, guide 25A on the lid 20 provides a tab that interlocks with guide 25B having a groove, as also shown in FIG. 8. FIG. 6 is a side view of the bottom 30 of the device 10 illustrating the use of various-sized wells 14. FIG. 8 shows the device 10 with the lid 20 and bottom interconnected by guides 25A and 25B. In another embodiment of the device 10, the bottom 30 includes a hanger hole 32 or other similar device for insertion of a key ring or other implement to carry or hang the device 10.

Figure 9:
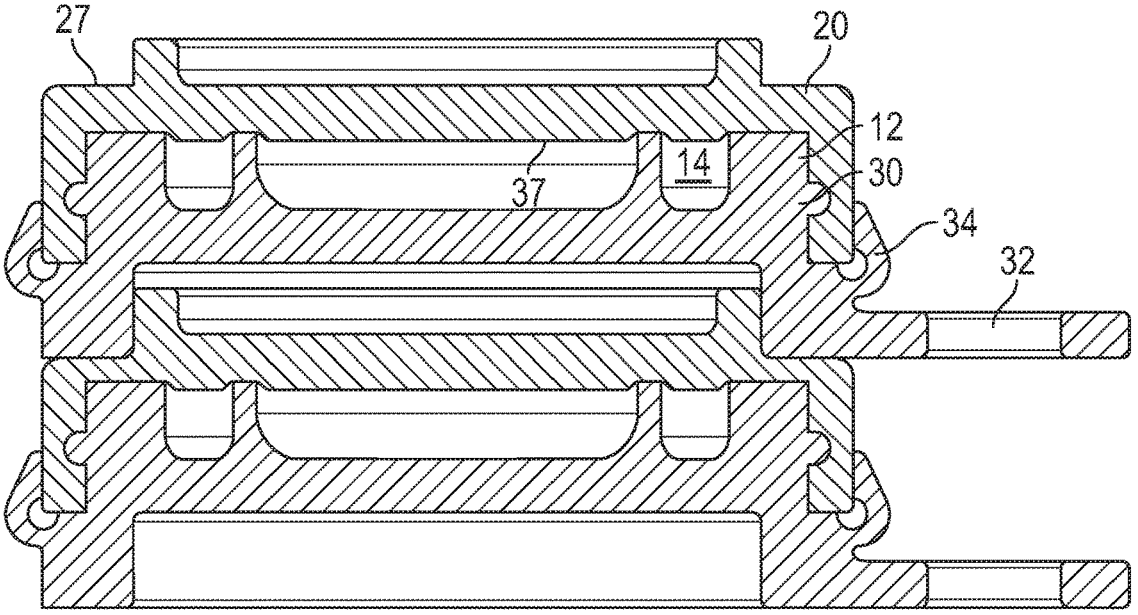
FIG. 9 is a side view of several of the devices in stacked format according to one exemplary embodiment.

Referring to FIGS. 7 and 9, in one embodiment, the device 10 includes a child safety feature. In this regard, the bottom 30 of the device 10 includes a flexible rim or lip 34 around the outside perimeter and extending upwardly to surround and engage the outside perimeter of the lid 20 when the device 10 is closed. To open and unseal the device 10, the user must pull back outwardly on the lip 34 to release the lid 20. As already noted, the lip 34 preferably includes a gap or groove 36 in which the guide 25A interlocks with guide 25B when the device 10 is closed.

Figure 5:
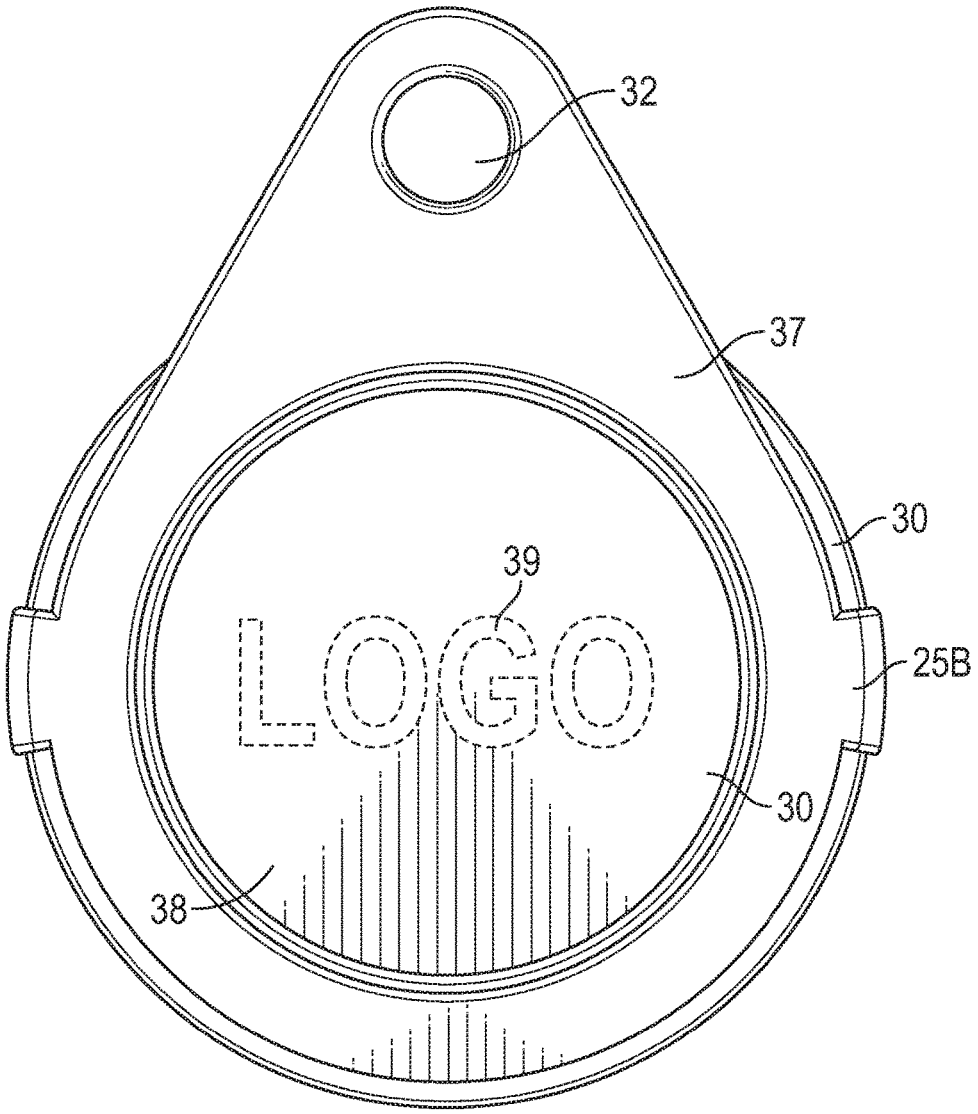
FIG. 5 is a top plan view of the bottom of the device showing an exemplary embodiment of the device.

Referring to FIGS. 5 and 9, in one embodiment, the device 10 can stack and interlock with other devices 10 by virtue of an inset area 28 on the outside 27 of the lid 20 which can nest within a corresponding inset area 38 on the outside 37 of the bottom portion 30 of the device 10. The outer perimeter of the inset 28 of the lid 20 preferably includes a rim 29 to flexibly lock the bottom inset area 38 into lid inset area 28. The inset areas 28 and 38 can be of any size or shape so long as they allow for a coordinating nesting and interlocking relationship between stacked devices. The interlocking function of the devices allows the user to carry multiple devices together and therefore easily transport additional pharmaceuticals. The insets 28 and 38 can further be used for placement of one or more logos or advertisements 22 and 39 (respectively).

The foregoing description has been presented for the purposes of illustration and description. It is not intended to be an exhaustive list or limit the invention to the precise forms disclosed. It is contemplated that other alternative processes and methods obvious to those skilled in the art are considered included in the invention. The description is merely examples of embodiments. It is understood that any other modifications, substitutions, and/or additions may be made, which are within the intended spirit and scope of the disclosure. From the foregoing, it can be seen that the exemplary aspects of the disclosure accomplishes at least all of the intended objectives.

The invention claimed is:

1. A pharmaceutical device for protecting and dispensing pharmaceuticals comprising: a bottom portion, said bottom portion including at least one well designed to hold an individual dose of a pharmaceutical; a lid, said lid including a cover for each well in the bottom portion, whereby each cover projects into the well to help protect the pharmaceutical from environmental factors, and further providing that the lid fits flush with the bottom portion to help prevent air or moisture from reaching the pharmaceutical, whereby a first guide on a tab on the bottom portion interlocks with a second guide on a tab on the lid when the device is closed, and further providing that the lid of the device includes an inset area which can nest within a corresponding inset area in the bottom portion of a second device, said inset area on the lid having an outer perimeter, and further providing a rim around the outer perimeter of the inset area of the lid in which the bottom inset area of the second device flexibly locks.

2. The device of claim 1 whereby the bottom includes multiple wells.

3. The device of claim 1 comprising at least one large sized well to hold a large sized pharmaceutical.

4. The device of claim 1 whereby the bottom and the lid comprise an insulating material.

5. The device of claim 1 whereby the tab on the bottom portion aligns with the tab on the lid to align the wells of the bottom portion with the well covers of the lid.

6. The device of claim 1 whereby the bottom portion includes a flexible rim which at least partially surrounds the lid when the device is closed.

7. The device of claim 6 whereby the flexible rim is configured so that the flexible rim must be extended outwardly from the lid to open the device.

8. The device of claim 1 further including a hanger hole for insertion of a key ring or implement to carry or hang the device.

9. A pharmaceutical device for protecting and dispensing pharmaceuticals comprising: a bottom portion, said bottom portion having an outer perimeter, said bottom portion including at least one well designed to hold an individual dose of a pharmaceutical; a lid, said lid having an outer perimeter, said lid including a cover for each well in the bottom portion, whereby each cover projects into the well to help protect the pharmaceutical from environmental factors, whereby the lid fits flush with the bottom portion to help prevent air or moisture from reaching the pharmaceutical, and further providing a flexible rim around the outer perimeter of the bottom portion and extending upwardly to overlap the length of and engage the outer perimeter of the lid when the device is closed, and which can only be opened by bending back or inverting the rim from the lid.

* * * * *